US006401482B1

(12) United States Patent
Lee et al.

(10) Patent No.: US 6,401,482 B1
(45) Date of Patent: Jun. 11, 2002

(54) DOOR COOLING APPARATUS FOR REFRIGERATOR WITH DOUBLE-ACTING DOOR

(75) Inventors: Jae Hee Lee; Sang Bae Kim, both of Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/929,343

(22) Filed: Aug. 15, 2001

(30) Foreign Application Priority Data

Aug. 16, 2000 (KR) ..... 2000-0047179
Aug. 16, 2000 (KR) ..... 2000-0047182

(51) Int. Cl.[7] ..... F25D 17/08
(52) U.S. Cl. ..... 62/408; 62/414; 454/195
(58) Field of Search ..... 62/408, 413, 414; 312/405; 454/195

(56) References Cited

U.S. PATENT DOCUMENTS 4,671,078 A * 6/1987 Pink ..... 239/587.1
5,573,323 A * 11/1996 Kim et al. ..... 312/405
5,765,388 A * 6/1998 Jeon ..... 62/408
5,946,934 A * 9/1999 Kim et al. ..... 62/187
5,979,174 A * 11/1999 Kim et al. ..... 62/404
6,038,880 A * 3/2000 Oh ..... 62/256
6,044,659 A * 4/2000 Ji ..... 62/186

* cited by examiner

*Primary Examiner*—William E. Tapolcai
(74) *Attorney, Agent, or Firm*—Fleshner & Kim, LLP

(57) ABSTRACT

A door cooling supply apparatus of a refrigerator with a double-acting door includes: a first cooling air separating duct and a second cooling air separating duct separated from a main cooling air duct; a door cooling air duct installed at the cooling compartment door to discharge cooling air from the cooling compartment door to the cooling compartment and connected to the first and the cooling air separating duct; a plurality of door opening sensing units for detecting an opening direction of the cooling compartment door; a controller for determining the opening direction of the cooling compartment door according to signals of the plurality of the door opening sensing units; and a cooling air switching unit installed at an area where the main cooling air duct is separated into the first cooling air separating duct and the second cooling air separating duct and selectively opening one of the first and the second cooling air separating duct controlled by the controller.

13 Claims, 9 Drawing Sheets

DOOR COOLING APPARATUS FOR REFRIGERATOR WITH DOUBLE-ACTING DOOR

BACKGROUND OF THE INVENTION

1. Field of the Invention

The present invention relates to a refrigerator with a so-called double-acting door, and more particularly, to a door cooling air supply apparatus of a refrigerator having a double-acting door that is capable of switching a flowing path of cooling air supplied from a refrigerator main body to a door when the door is selectively opened rightward or leftward of the refrigerator main body.

2. Description of the Background Art

FIG. 1 is a schematic view showing the structure of a door cooling air supply apparatus of a refrigerator in accordance with the conventional art, and FIG. 2 is a cross-sectional view taken along line A–A' in FIG. 1 detailing a cooling air flowing path in the state that the door of the refrigerator of FIG. 1 is closed.

As shown in FIGS. 1 and 2, the refrigerator includes a main body 10 including a freezing compartment and a cooling compartment 13 and a freezing compartment door 15 and a cooling compartment door 17 hinged at one side of the main body 10 to open and close the front openings of the freezing compartment and the cooling compartment 13.

Shelves 19 are disposed one above the other inside the cooling compartment 13, and a cooling compartment cooling duct 21 is disposed extending in the vertical direction at a rear side of the cooling compartment 13 of the main body to discharge cooling air into the cooling compartment 13.

A cooling air conduit duct 23 is buried inside the insulation behind the liner forming the rear wall and the right wall of the cooling compartment 13 to communicate cooling air from the duct 21 to the cooling compartment door 17. A connection end portion 24 is formed at the front opening region of the duct 23 to communicate with a door cooling duct (to be described).

A plurality of door pockets 18 are separately disposed on panel face of the cooling compartment door 17.

A door cooling air duct 25 is formed at the central area of the cooling compartment door 17 for supplying cooling air to bottle type foodstuffs such as bottled beverages kept in the door pockets 18 disposed below, in communication with the cooling air conduit duct 23.

A plurality of cooling air discharging holes 26 for discharging cooling air therethrough are separately in the door cooling air duct 25 arranged along the longitudinal direction thereof.

A connecting portion 28 is formed at a hinge coupling portion side area of the door cooling air duct 25 to communicate with the connecting end portion 24 of the cooling air conduit duct 23 so that cooling air can flow in thereto from the cooling air conduit duct 23.

The above-described conventional door cooling apparatus for a refrigerator, however, has a problem that since the cooling air conduit duct 23 for supplying cooling air to the cooling compartment door 17 is buried in the insulation behind the liner forming the rear wall and the right wall of the cooling compartment 13, which is integrally formed with the main body 10, it is impossible to change the cooling air passage arrangement after manufacture.

Alternatively, in case of a refrigerator with a so-called "double-acting" door in which a door is hinged at both sides whereby it can be selectively opened rightward and leftward, when the cooling compartment door 17 is pivoted around the side opposite to the side where the connecting portions 24, 28 for communicating of the refrigerator cooling air conduit duct 23 with the door cooling air duct 25 is formed, since the connecting portions 24, 28 of the cooling air conduit duct 23 and the door cooling air duct 25 hardly align with each other accurately, in such case cooling air is leaked or is not smoothly supplied from the main body 10 to the cooling compartment door 17 while the door is opened.

SUMMARY OF THE INVENTION

Therefore, an object of the present invention is to provide a door cooling air supply apparatus for a refrigerator with a double-acting door that is capable of switching a flow passage of cooling air supplied from a main body to a door according to an opening direction of the door when the door is selectively opened leftward or rightward of the main body.

To achieve these and other advantages and in accordance with the purpose of the present invention, as embodied and broadly described herein, there is provided a door cooling supply apparatus for a refrigerator with a main cooling air duct and a double-acting door including: a first cooling air separating duct and a second cooling air separating duct separated from the main cooling air duct; a door cooling air duct installed at the cooling compartment door to discharge cooling air from the cooling compartment door to the cooling compartment and connected to the first and the second cooling air separating ducts; a plurality of door opening sensing means for detecting an opening direction of the cooling compartment door; a controller for determining the opening direction of the cooling compartment door according to the detection made by the door opening sensing means; and a cooling air switching unit installed at an area where the main cooling air duct is separated into the first cooling air separating duct and the second cooling air separating duct and selectively opening one of the first and the second cooling air separating duct controlled by the controller.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
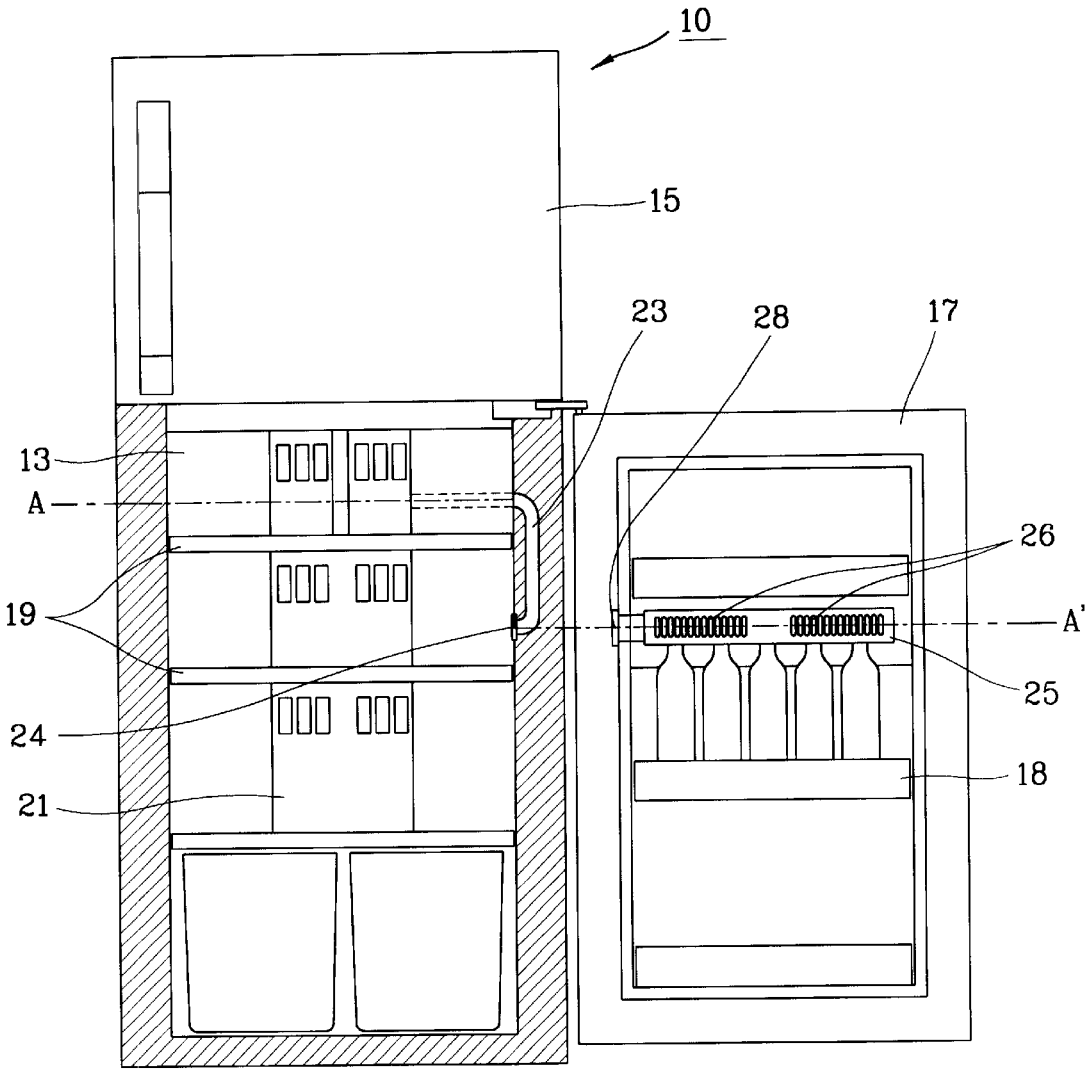
FIG. 1 CONVENTIONAL ART
FIG. 1 is a schematic view showing the structure of a door cooling apparatus of a refrigerator in accordance with the conventional art.
Figure 2:
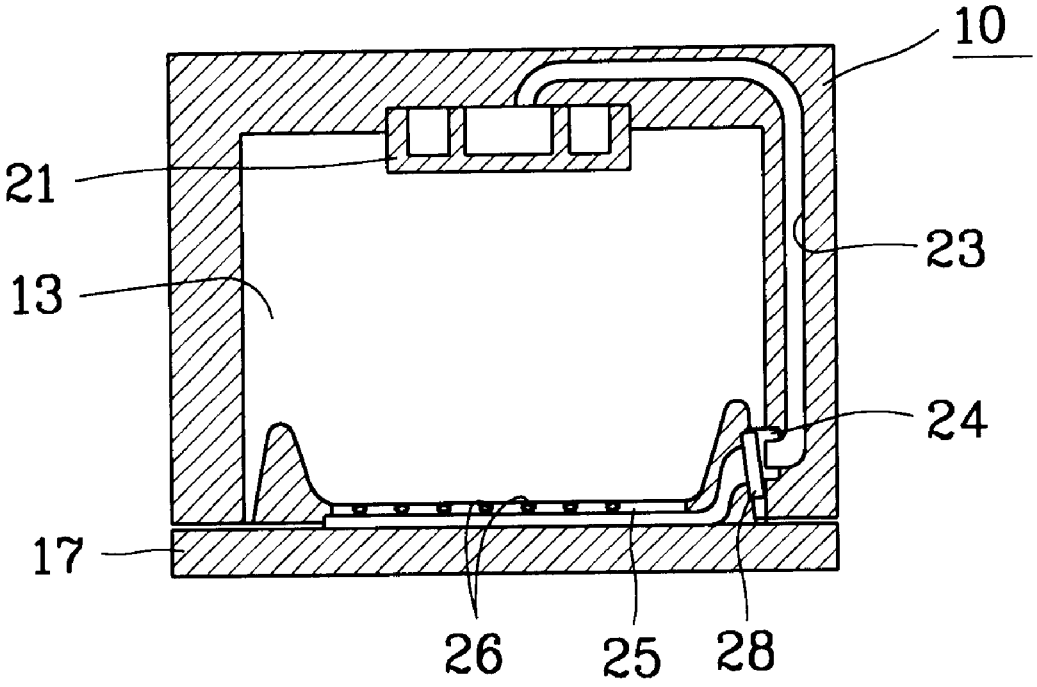
FIG. 2 CONVENTIONAL ART
FIG. 2 is a cross-sectional view taken along line A–A' in FIG. 1 showing a cooling air flowing path in a state that the door of the refrigerator is closed.
Figure 3:
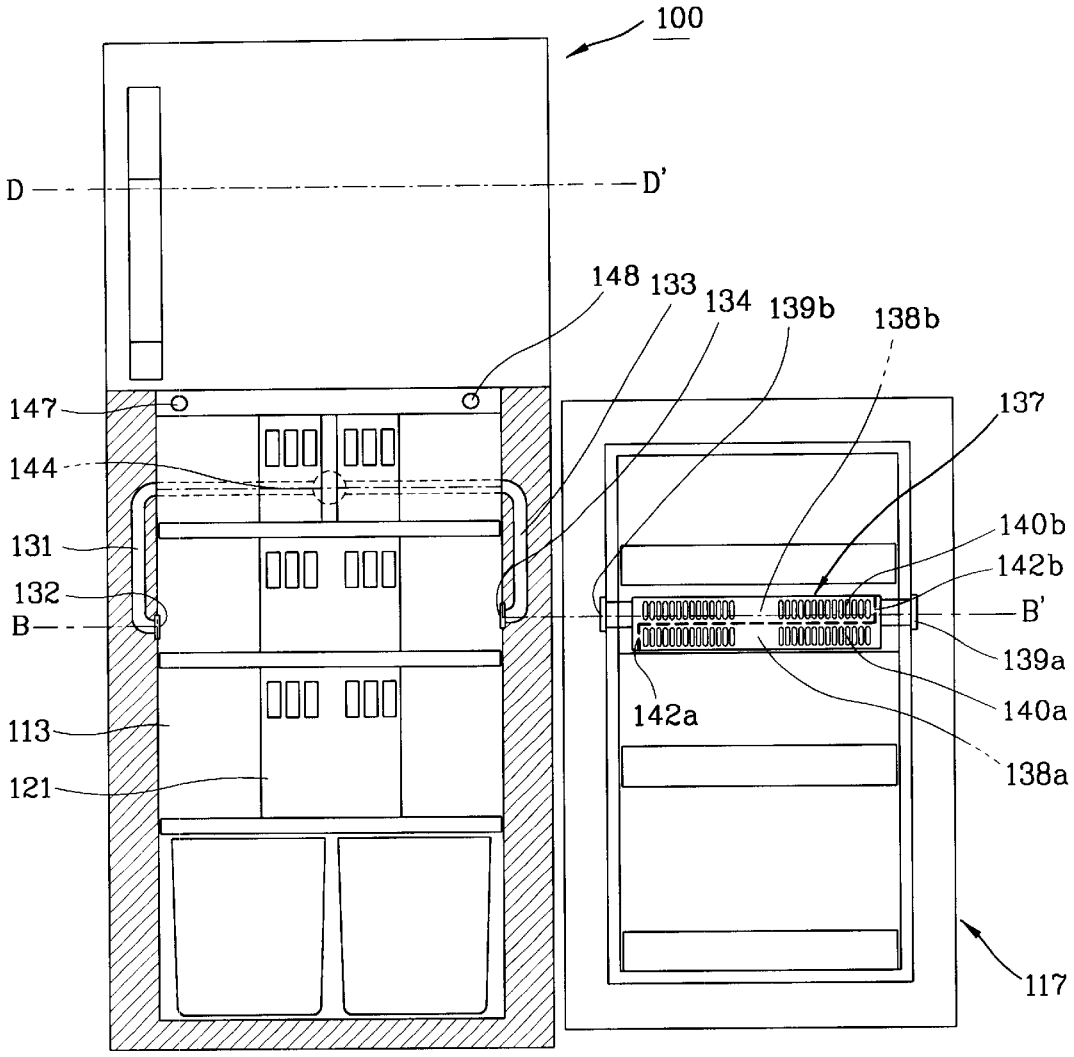
FIG. 3 is a schematic view showing the structure of a door cooling apparatus of a cooling compartment door of a refrigerator with a double-acting door in accordance with a first embodiment of the present invention.
Figure 4:
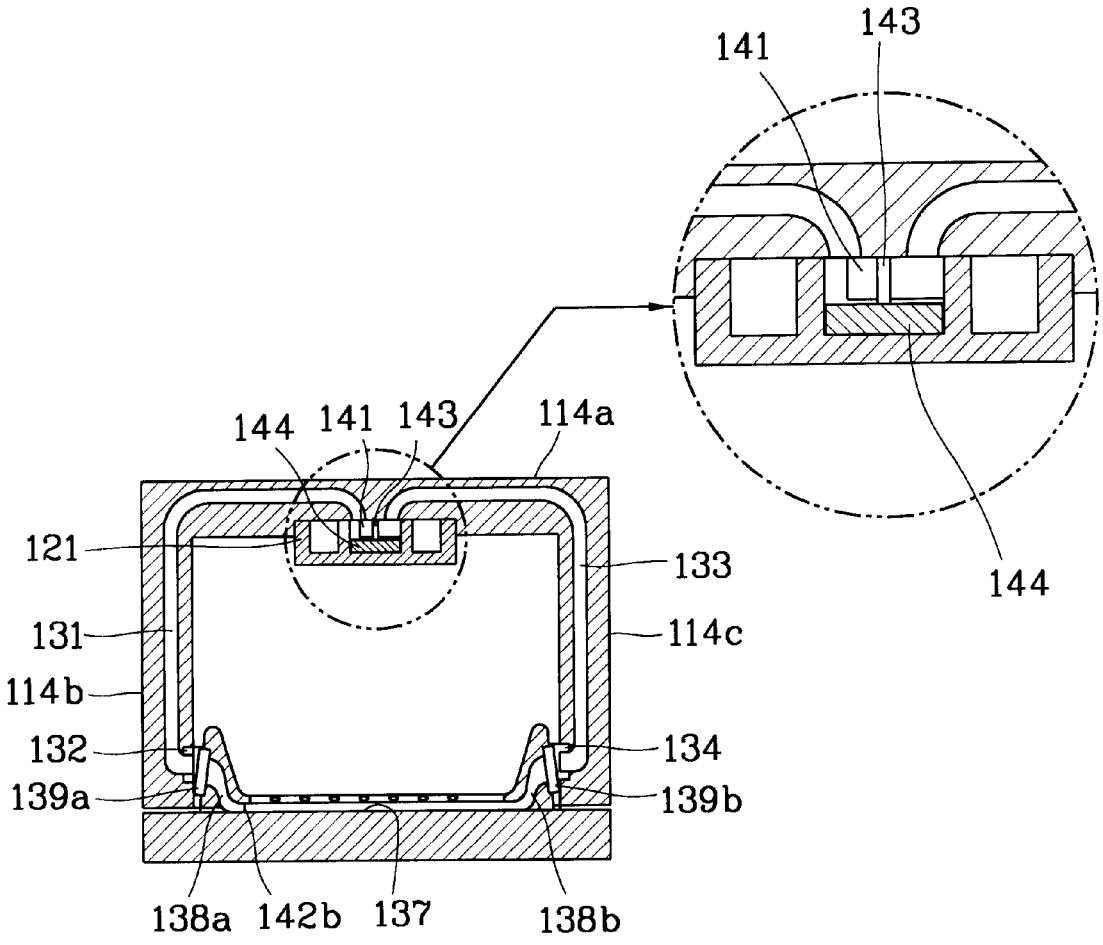
FIG. 4 is a sectional view taken along line B–B' in FIG. 3 showing a cooling air flowing path in accordance with the first embodiment of the present invention.
Figure 5:
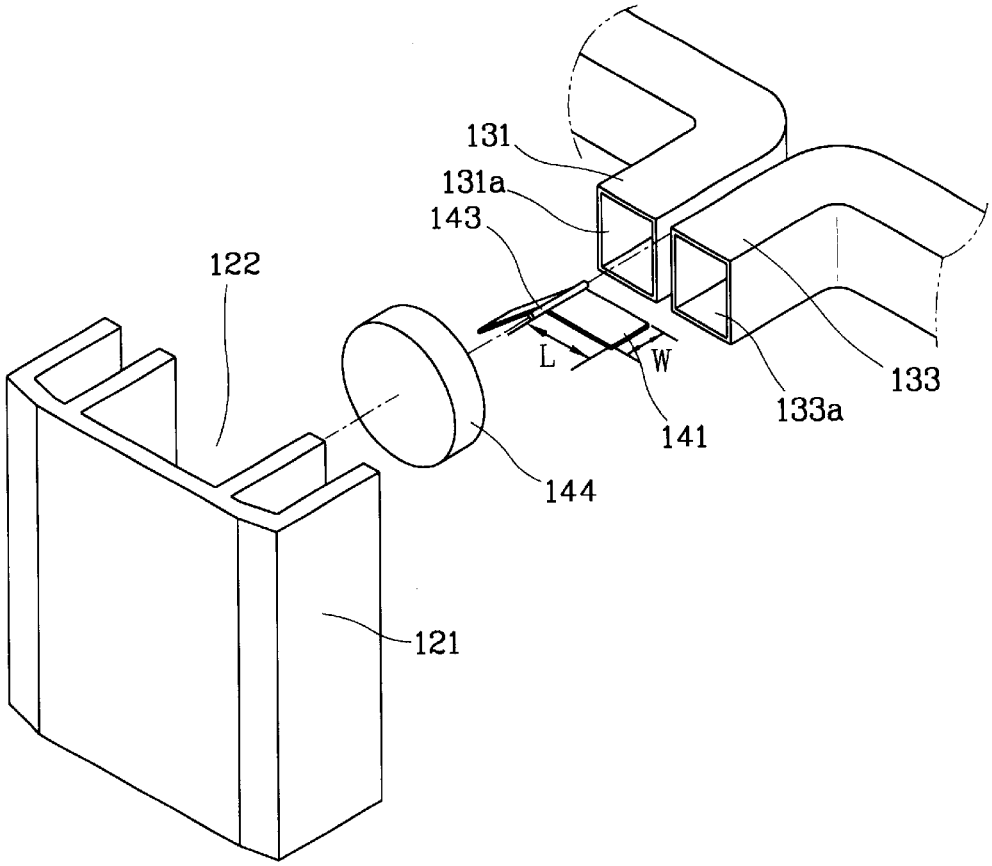
FIG. 5 is an exploded perspective view of a cooling air flowing path switching unit in FIG. 4 in accordance with the first embodiment of the present invention.
Figure 6:
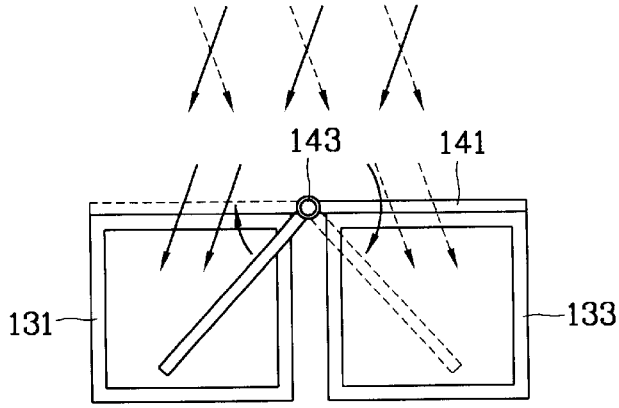
FIG. 6 is a sectional view showing operating states of the cooling air flowing path switching unit in FIG. 5 in accordance with the first embodiment of the present invention.

FIG. 3 is a schematic view showing the structure of a door cooling apparatus of a cooling compartment door of a refrigerator with a double-acting door in accordance with a first embodiment of the present invention. FIG. 4 is a sectional view taken along line B–B' in FIG. 3 showing a cooling air flowing path in accordance with the first embodiment of the present invention. FIG. 5 is an exploded perspective view of a cooling air switching unit shown in FIG. 4 in accordance with the first embodiment of the present invention. And FIG. 6 is a sectional view showing an operating state of the cooling air switching unit shown in FIG. 5 in accordance with the first embodiment of the present invention.

As shown in the drawings, a freezing compartment 313 and a cooling compartment 113 are formed in a main body 110 one atop the other, and a cooling compartment door 117 is installed on the main body 110 at the cooling compartment 113 to open and close the cooling compartment 113 by means of a hinge arrangement (not shown) which permits opening of the door 117 at either side.

The door cooling air supply apparatus for a refrigerator with a double-acting door includes a first cooling air separating duct 131, one end of which is coupled to a main cooling air duct 121 of the cooling compartment and the other end passes along the left wall 114*b* of the cooling compartment 113 from the rear wall 114*a* of the cooling compartment 113 to discharge cooling air toward a front opening area. Also, a second cooling air separating duct 133, one end of which is coupled to the main cooling air duct 121 of the cooling compartment, and the other end is formed to discharge from the rear wall 114*a* of the cooling compartment 113 by way of a right wall 114*c* of the cooling compartment 113 toward the front opening area of the cooling compartment 113; a door cooling air duct 137 installed at an inner plate surface of the cooling compartment door 117, both ends thereof being connected to the first cooling air separating duct 131 and the second cooling air separating duct 133 so that cooling air can flow; a cooling air switching member 141 rotatably disposed inside the main cooling duct 121 of the cooling compartment so that the upper end portions of the first and the second cooling air separating ducts (131,133) are selectively blocked; a drive motor 144 for rotatably driving the cooling air switching member 141; and a first door opening sensing switch 147 and a second door opening sensing switch 148 inserted between the cooling compartment door 117 and the main body 110, for sensing an opening direction of the cooling compartment door 117, respectively.

That is, the first door opening sensing switch 147 and the second door opening sensing switch 148 for sensing the opening direction of the cooling compartment door 117 are installed isolated in the horizontal direction at the front upper connecting portion of the cooling compartment 113 of the main body 110.

When the sensing switches 147 and 148 contact the cooling compartment door 117, they recognize that the cooling compartment door 117 is closed.

One end of each of the first cooling air separating duct 131 and the second cooling air separating duct 133 are coupled to communicate with the upper area of the main cooling air duct 121 of the cooling compartment, which is extended to the left wall 114*b* and the right wall 114*c* of the cooling compartment 113 in the horizontal direction, and also downwardly extended to be corresponded to the height of the door cooling air duct 137 to form connection end portions 132 and 134 so that cooling air can be discharged to the front opening area of the cooling compartment 113.

As shown in FIG. 5, in the cooling air flowing direction, end portions of entrances 131*a* and 133*a* of each of the first cooling air separating duct 131 and the second cooling air separating duct 133 are bent toward the main cooling air duct 121 of the cooling compartment and disposed in parallel, and perpendicular to the main cooling duct 121 of the cooling compartment.

A flow passage 122 is formed inside the main cooling air duct 121, so that cooling air can flow in through the upper end portions 131*a* and 133*a* of the first cooling air separating duct 131 and the second cooling air separating duct 133 from an upper portion.

A cooling air switching member 141 is rotatably installed centering around a driving shaft 143 disposed in the backward-forward direction of the cooling compartment 113 at an upper side of the upper end portions 131*a* and 133*a* of the first and the second cooling air separating ducts 131 and 133.

The cooling air switching member 141 is a plate member having a width (W) corresponding to the width of the first and the second cooling air separating ducts 131 and 133 in the horizontal direction and a length (L) corresponding to the front-rear distance of the main cooling air duct 121 of the cooling compartment in the backward-forward direction, formed in the inverse 'V' sectional shape to be received and coupled to the rear face of the main cooling air duct 21 of the cooling compartment.

The driving shaft 143 is formed extended in the backward-forward direction of the cooling compartment 113 at the bent portion of the cooling air switching member 141.

The driving motor 144 for rotatably driving the cooling air switching member 141 is integrally and rotatably coupled at one end of the driving shaft 143.

The door cooling air duct 137 is disposed in the horizontal direction at the central upper area of an inner plate surface of the cooling compartment door 117, and a first flow passage 138*a* and a second flow passage 138*b* are formed divided in the vertical direction inside the door cooling air duct 137.

A first connecting portion 139*a* is formed connected to communicated with the first cooling air separating duct 131 at the influx side of the first flow passage 138*a*, and a second connecting portion 139*b* is formed connected to communicate with the second cooling air separating duct 133 at the influx side of the second flow passage 138*b*.

As shown in FIG. 3, cooling air discharge holes 140*a* and 140*b* are formed at the first flow passage 138*a* and the second flow passage 138*b* so that cooling air flowing in through the connecting portions 139*a* and 139*b* can be discharged therethrough, and the lower end portions 142*a* and 142*b* of the first flow passage 138*a* and the second flow passage 138*b* are blocked according to the flowing direction of the cooling air.

Figure 7:
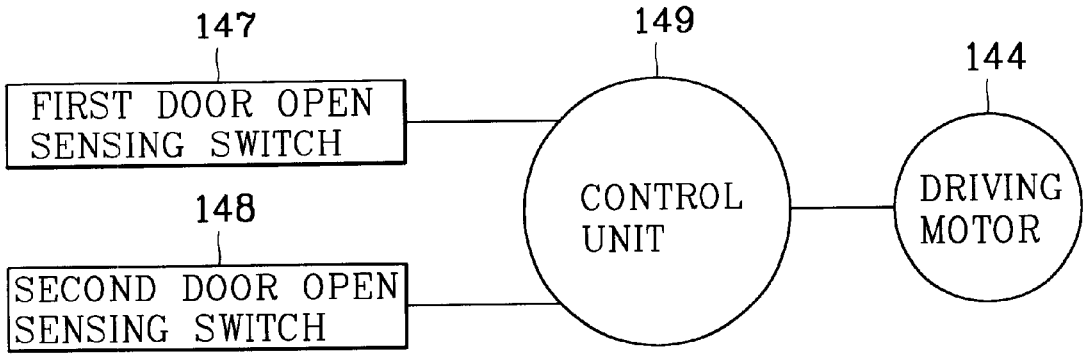
FIG. 7 is a control flow chart of the door cooling apparatus of a cooling compartment door of a refrigerator with a double-acting door in accordance with the first embodiment of the present invention.

With this construction, as shown in FIG. 7, when the cooling compartment door 117 is rotated and opened pivoting around the right connecting portion at the front side of the main body 110, the first door opening sensing switch 147 is first isolated from the cooling compartment door 117 earlier than the second door opening sensing switch 148, so that the controller 149 senses it and determines that the cooling compartment door 117 is opened rightward, and accordingly, the cooling air switching member 141 controls the driving motor 144 to block the area of the upper end portion 133*a* of the second cooling air separating duct 133.

Accordingly, after the cooling compartment door 117 is closed, the cooling air from the main cooling air duct 121 of the cooling compartment is introduced into the upper end portion 131*a* of the first cooling air separating duct 131, flowing therein, and introduced into the first flow passage 140*a* through the first connecting portion 139*a* of the door cooling air duct 137 and then discharged through the cooling air discharge holes 140*a*.

Meanwhile, when the cooling compartment door 117 is opened pivoting around the hinge mounted at the left side of the main body 110, conversely to the above-described case, the second door opening sensing switch 148 is first isolated from the cooling compartment door 117 earlier than the first door opening sensing switch 147. Then, the controller determines that the cooling compartment door 117 is opened leftward and controls the driving motor 144 so that the cooling air switching member 141 can block the are of the upper end portion 131*a* of the first cooling air separating duct 131.

Accordingly, after the cooling compartment door 117 is closed, cooling air from the main cooling air duct 121 of the cooling compartment is introduced into the upper end portion 133*a* of the second cooling air separating duct 133, flows toward the door cooling air duct 137, is introduced into the second flow passage 140*b* through the second connecting portion 139*b* of the door cooling air duct 137, and then discharged through the cooling air discharge holes 140*b*.

Unlike the door cooling air supply apparatus of a refrigerator with a double-acting door in accordance with the first embodiment of the present invention, the cooling air switching unit can be manually switched. The structure of such door cooling air supply apparatus will now be described.

Figure 8:
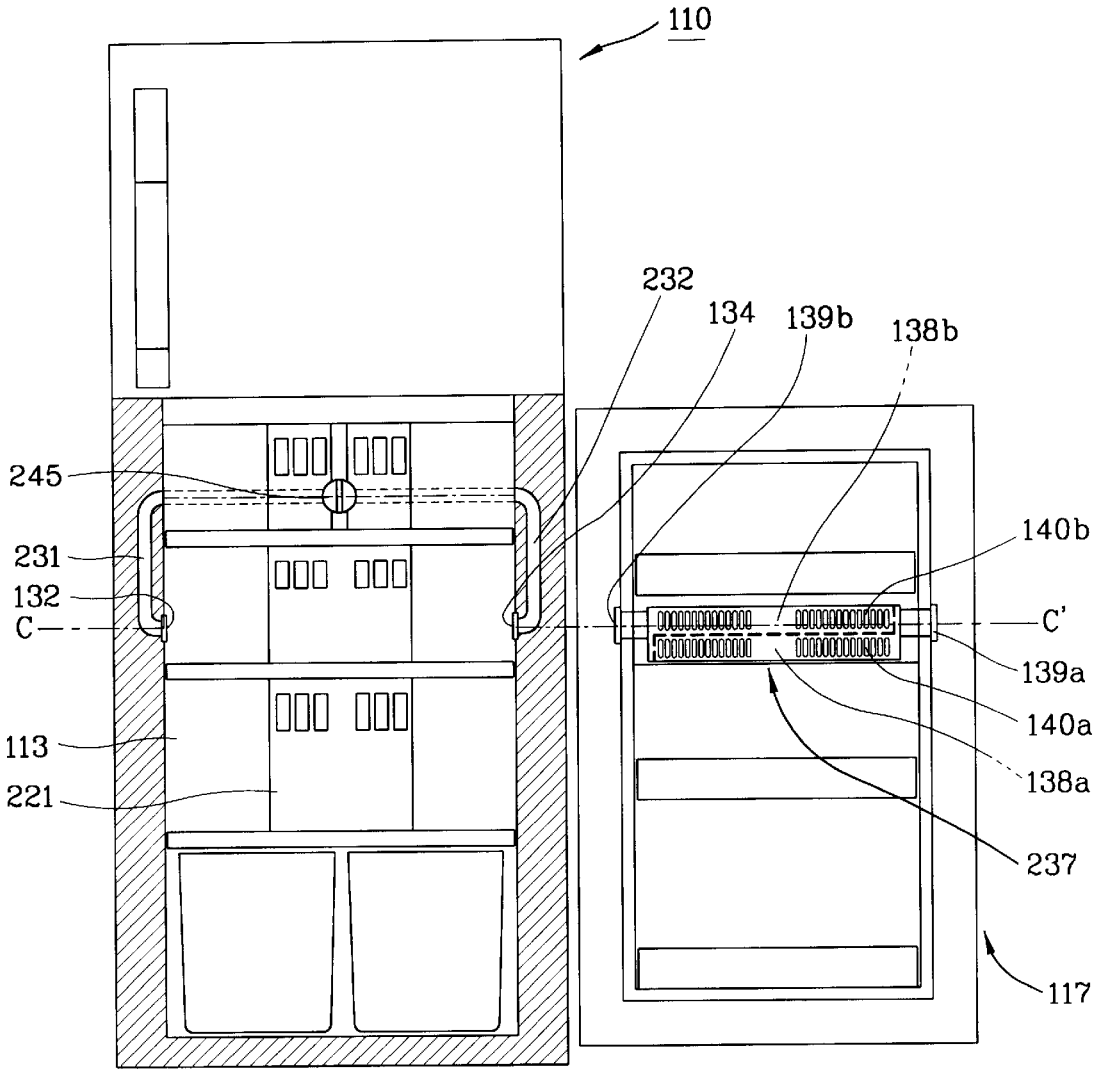
FIG. 8 is a schematic view of a door cooling apparatus of a cooling compartment door of a refrigerator with a double-acting door in accordance with a second embodiment of the present invention.
Figure 9:
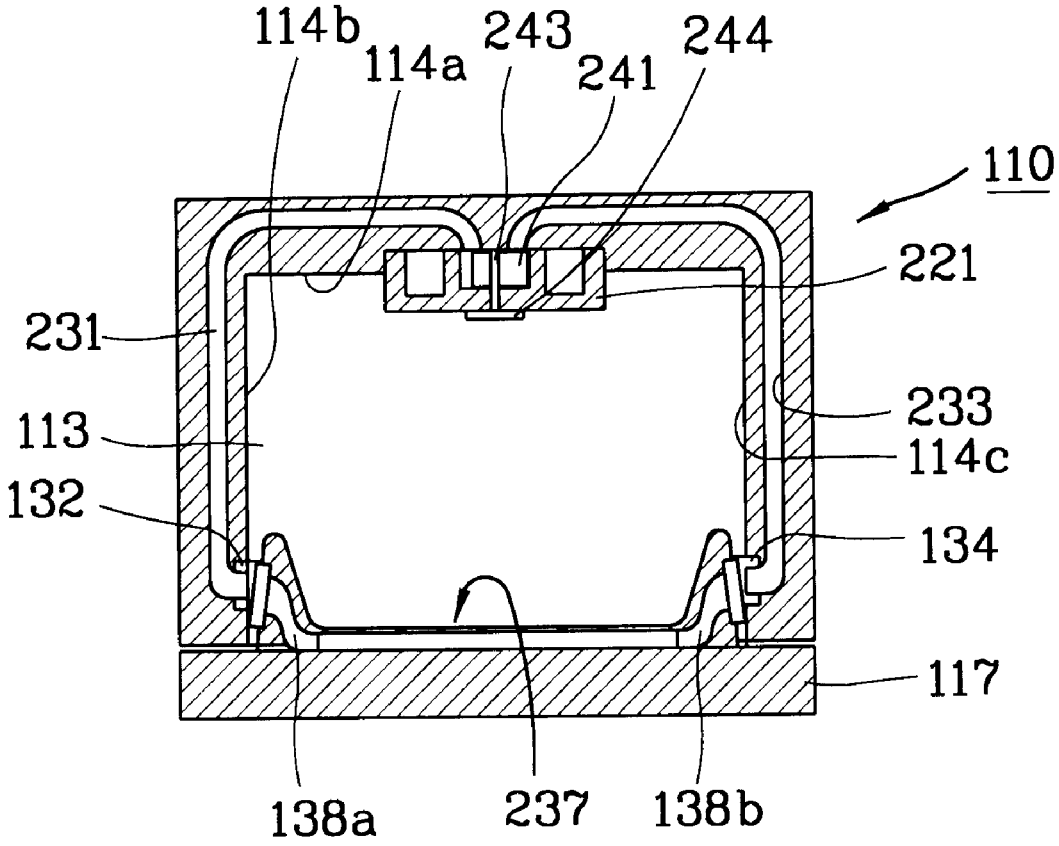
FIG. 9 is a sectional view taken along line C–C' in FIG. 8 showing a cooling air flowing path in accordance with the second embodiment of the present invention.
Figure 10:
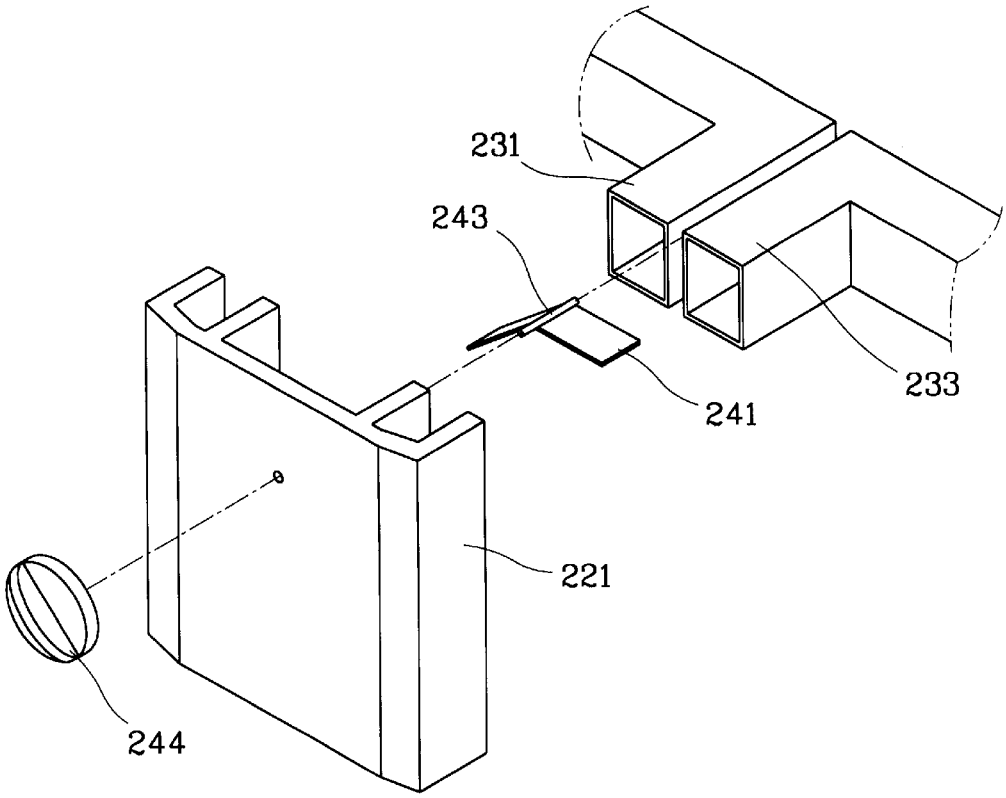
FIG. 10 is an exploded perspective view of a cooling air switching unit in FIG. 9 in accordance with the second embodiment of the present invention.

FIG. 8 is a schematic view of a door cooling apparatus of a freezing compartment door of a refrigerator with a double-acting door in accordance with a second embodiment of the present invention, FIG. 9 is a sectional view taken along line C–C' of FIG. 8 showing a cooling air flowing direction in accordance with the second embodiment of the present invention, and FIG. 10 is an exploded perspective view of a cooling air switching unit in FIG. 9 in accordance with the second embodiment of the present invention.

As shown in the drawings, the door cooling air supply apparatus of a refrigerator with a double-acting door in accordance with the second embodiment of the present invention includes a first cooling air separating duct 231 and a second cooling air separating duct 233 separated from a main cooling air duct 221 of a cooling compartment 113; a door cooling air duct 237 installed at the cooling compartment door 117 so that cooling air can be discharged from the cooling compartment door 117 to the cooling compartment 113, and connected to the first cooling air separating duct 231 and the second cooling air separating duct 233; and a cooling air switching unit installed at an area where the main cooling air duct 221 is separated into the first cooling air separating duct 231 and the second cooling air separating duct 233, and selectively opening one of the first cooling air separating duct 231 and the second cooling air separating duct 233.

The cooling air switching unit includes a control handle 244 having a rotational shaft 243 and a shielding plate 241 for selectively opening one of the first cooling air separating duct 231 and the second cooling air separating duct 233 according to the rotation of the control handle 244.

Especially, the control handle 244 is installed outside the main cooling air duct 221, the rotational shaft 243 of the control handle 244 penetrates the main cooling air duct 221, the first and the second cooling air separating ducts 231 and 233 are disposed perpendicular to the main cooling air duct 221 of the cooling compartment 113, the rotational shaft 243 of the control handle 244 is extended, the shielding plate 241, that is, formed by two plates forming a constant angle, is connected to the rotational shaft 243, so that one the first cooling air separating duct 231 or the second cooling air separating duct 233 is selectively opened according to the rotation of the shielding plate 241.

For example, If the cooling compartment door is opened rightward, a user rotates the control handle 244 so that the shielding plate 241 blocks the first cooling air separating duct 231 and opens the second cooling air separating duct 233.

In the reverse case, the user rotates the control handle 243 so that the shielding plate 241 blocks the second cooling air separating duct 233 and opens the first cooling air separating duct 231.

Though the above presented embodiments describe the cooling compartment door, the door cooling air supply apparatus of the embodiments can be also adopted to a freezing compartment door.

Figure 11:
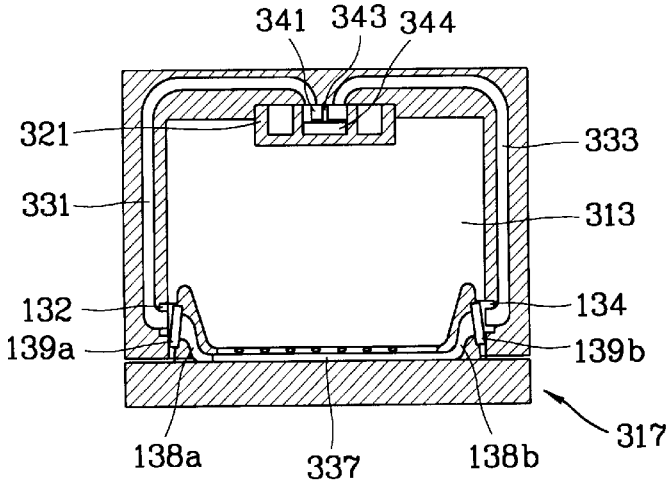
FIG. 11 is a sectional view taking along line D–D' in FIG. 3 showing a cooling air flowing path of the door cooling apparatus of a freezing compartment door of a refrigerator with a double-acting door in accordance with a third embodiment of the present invention.

FIG. 11 is a sectional view taking along line D–D' in FIG. 3 showing a cooling air flowing path of the door cooling apparatus of a freezing door of a refrigerator with a double-acting door in accordance with a third embodiment of the present invention.

As shown in FIG. 11, a door cooling air supply apparatus of a freezing compartment door 317 of a refrigerator with a double-acting door, includes a first cooling air separating duct 331 and a second cooling air separating duct 333 separated from a main cooling air duct 321 of a freezing compartment 313; a door cooling air duct 337 installed at the freezing door 317 to discharge cooling air from the freezing compartment door 317 to the freezing compartment 313, and connected to the first and the second cooling air separating ducts 331 and 333; a door opening sensing unit (not shown) for sensing an opening direction of the freezing compartment door 317; a controller 149 for determining an opening direction of the freezing door 317 according to a signal of the door opening sensing unit; cooling air switching units 341, 343 and 344 installed at an area where the main cooling air duct 321 is separated into the first cooling air separating duct 331 and the second cooling air separating duct 333, and selectively opening one of the first cooling air separating duct 331 and the second cooling air separating duct 333 under the control of the controller 349.

The door cooling air supply apparatus of the freezing compartment door 317 of a refrigerator with a double-acting door constructed as described above is operated in the same manner as that of the door cooling air supply apparatus of the cooling compartment door.

In addition, the door cooling air supply apparatus of a cooling compartment door of a refrigerator with a double-acting door of the second embodiment of the present invention can be also adopted to the freezing compartment door in the similar manner.

As so far described, the door cooling air supply apparatus of a refrigerator with a double-acting door has the following advantage.

That is, by automatically and manually changing the cooling air supply direction according to the opening direction of a door, cooling air can be more effectively supplied into the refrigerator.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A door cooling air supply apparatus of a refrigerator with a double-acting door and a main cooling air duct, comprising:

a first cooling air separating duct and a second cooling air separating duct separated from the main cooling air duct and disposed at respective opposite sides thereof;

a door cooling air duct installed at the cooling compartment door to discharge cooling air from the cooling compartment door to the cooling compartment and connected to the first and the second cooling air separating ducts; and a cooling air switching unit installed between the main cooling air duct and the first and second cooling air separating ducts and selectively communicating one of the first and the second cooling air separating ducts with the main cooling air duct.

2. The apparatus of claim 1, wherein the door cooling air supply apparatus further comprises:

a plurality of door opening sensing units for detecting an opening direction of the cooling compartment door; and a controller for determining the opening direction of the cooling compartment door according to signals of the plurality of the door opening sensing units; and the cooling air switching unit is controlled by the controller.

3. The apparatus of claim 2, wherein the cooling air switching unit comprises:

a driving motor controlled by the controller; and a shielding plate driven by the driving motor, for selectively opening an end of one of the first cooling air separating duct and the second cooling air separating duct.

4. The apparatus of claim 3, wherein end openings of the first and the second cooling air separating ducts are disposed perpendicular to the main cooling air duct of the cooling compartment and the shielding plate is formed by two plates forming predetermined angle therebetween and connected to a rotational shaft driven by the driving motor, so that an end one of the first and the second cooling air separating ducts is selectively opened according to a ratation of the shielding plate.

5. The apparatus of claim 2, wherein the door opening sensing unit includes a first door opening sensing switch and a second door opening sensing switch respectively installed at a left and a right side of an upper connecting portion of the cooling compartment, to sense an opening direction of the cooling compartment door.

6. The apparatus of claim 5, wherein the first and the second cooling air separating ducts pass via a left wall and a right wall of the cooling compartment.

7. The apparatus of claim 6, wherein in the case that the cooling compartment door is opened rightward, the cooling air switching unit opens the first cooling air separating duct so that cooling air can flow to the first cooling air separating duct, while, in case that the cooling compartment door is opened leftward, the cooling air switching unit opens the second cooling air separating duct so that cooling air can flow to the second cooling air separating duct.

8. The apparatus of claim 1, wherein the first and the second cooling air separating ducts pass via respective side walls of the cooling compartment.

9. The apparatus of claim 1, wherein the door cooling air duct includes a first flow passage and a second flow passage which are separately divided therein, and the first flow passage communicates with the first cooling air separating duct and the second flow passage communicates with the second cooling air separating duct.

10. The apparatus of claim 1, wherein the cooling air switching unit comprises:

a control handle having a rotational shaft; and a shielding plate connected to the rotational shaft for selectively opening one of the first cooling air separating duct and the second cooling air separating duct according to the rotation of the control handle.

11. The apparatus of claim 10, wherein the control handle is installed outside the main cooling air duct, the rotational shaft of the control handle penetrates the main cooling air duct, ends of the first and the second cooling air separating ducts and are disposed perpendicular to the main cooling air duct of the cooling compartment, the shielding plate is formed by two plates forming a constant mutual angle and connected to the rotational shaft, so that one the first cooling air separating duct or the second cooling air separating duct is selectively opened according to the rotation of the shielding plate.

12. A door cooling air supply apparatus of a refrigerator with a double-acting freezing compartment door and a main cooling air duct in a freezing compartment thereof, comprising:

a first cooling air separating duct and a second cooling air separating duct separated from the main cooling air duct of the freezing compartment; and a door cooling air duct installed at the freezing compartment door to discharge cooling air from the freezing compartment door to the freezing compartment, and connected to the first and the second cooling air separating ducts; and a cooling air switching unit installed at an area where the main cooling air duct is separated into the first cooling air separating duct and the second cooling air separating duct, and selectively opening one of the first cooling air separating duct and the second cooling air separating duct.

13. The apparatus of claim 12, wherein the door cooling air supply apparatus further comprises:

a plurality of door opening sensing units for detecting an opening direction of the freezing compartment door; and a controller for determining the opening direction of the freezing compartment door according to signals of the plurality of the door opening sensing units; and the cooling air switching unit is controlled by the controller.

* * * * *